US012187481B1

(12) United States Patent
Bison

(10) Patent No.: US 12,187,481 B1
(45) **Date of Patent: *Jan. 7, 2025**

(54) PALLET WRAPPING SYSTEM WITH INTELLIGENT MONITORING

(71) Applicant: Darrel Bison, Phoenix, AZ (US)

(72) Inventor: Darrel Bison, Phoenix, AZ (US)

(73) Assignee: ALLIED PACKAGING CORPORATION, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/393,193

(22) Filed: Dec. 21, 2023

Related U.S. Application Data

(63) Continuation of application No. 17/570,269, filed on Jan. 6, 2022, now Pat. No. 11,912,452.

(51) Int. Cl.

| | |
|---|---|
| ***B65B 41/16*** | (2006.01) |
| ***B65B 11/02*** | (2006.01) |
| ***B65B 57/00*** | (2006.01) |
| *B65B 11/00* | (2006.01) |

(52) U.S. Cl.
CPC ..... *B65B 57/00* (2013.01); *B65B 11/025* (2013.01); *B65B 41/16* (2013.01); *B65B 2011/002* (2013.01)

(58) Field of Classification Search
USPC ..... 53/507
See application file for complete search history.

(56) References Cited

U.S. PATENT DOCUMENTS

| | | | |
|---|---|---|---|
| 1,109,461 | A | 9/1914 | Price |
| 1,351,809 | A | 9/1920 | Sutherland |
| 2,026,282 | A | 12/1935 | Leguillon |
| 2,823,530 | A | 2/1958 | Rikard |

(Continued)

FOREIGN PATENT DOCUMENTS

| | | |
|---|---|---|
| CL | 199600979 | 3/1997 |
| CL | 199602233 | 9/1997 |

(Continued)

OTHER PUBLICATIONS

JPO machine translation of JP 10-129609 A, Aug. 14, 2013, 4 pages.

(Continued)

*Primary Examiner* — Chinyere J Rushing-Tucker
(74) *Attorney, Agent, or Firm* — Booth Udall Fuller, PLC; Kenneth C. Booth

(57) ABSTRACT

A monitoring system for wrapping a pallet with a pallet wrapping system, at least two encoders, and a control box. The pallet wrapping system has a spool that dispenses stretch film and a pre-stretch machine operably coupled to the pallet wrapping system and configured to elongate the stretch film. The at least two encoders are affixed to the pre-stretch machine. A first of the at least two encoders is configured to measure a length of stretch film entering the pre-stretch machine and a second is configured to measure a length of stretch film exiting the pre-stretch machine. The control box is communicatively coupled to the at least two encoders and configured to collect data regarding the pallet wrapping system and transmit the data over a wireless connection to a central processor configured to gather the data.

20 Claims, 3 Drawing Sheets

(56) References Cited

U.S. PATENT DOCUMENTS

| | | | |
|---|---|---|---|
| 3,019,573 | A | 2/1962 | Navikas |
| 3,793,798 | A | 2/1974 | Lancaster |
| 3,896,604 | A | 7/1975 | Marantz |
| 4,102,513 | A | 7/1978 | Guard |
| 4,166,589 | A | 9/1979 | Hoover |
| 4,172,608 | A | 10/1979 | Brown, Jr. |
| 4,235,062 | A | 11/1980 | Lancaster, III |
| 4,255,918 | A | 3/1981 | Lancaster |
| 4,353,515 | A | 10/1982 | Weaver |
| 4,369,614 | A | 1/1983 | Tetzner |
| 4,409,776 | A | 10/1983 | Usui |
| 4,468,922 | A | 9/1984 | McCrady |
| 4,530,473 | A | 7/1985 | Parry |
| 4,619,102 | A | 10/1986 | Geisinger |
| 4,671,043 | A | 6/1987 | Forni |
| 4,723,393 | A | 2/1988 | Silbernagel |
| 4,739,945 | A | 4/1988 | Yokoe |
| 4,754,594 | A | 7/1988 | Lancaster |
| 4,807,427 | A | 2/1989 | Casteel |
| 4,827,700 | A | 5/1989 | Rampe |
| 4,845,920 | A | 7/1989 | Lancaster |
| 4,905,448 | A | 3/1990 | Plitt |
| 4,905,451 | A | 3/1990 | Jaconelli |
| 4,961,306 | A | 10/1990 | Sawhney |
| 5,031,771 | A | 7/1991 | Lancaster |
| 5,079,898 | A | 1/1992 | Springs |
| 5,107,657 | A | 4/1992 | Diehl |
| 5,125,209 | A | 6/1992 | Thimon |
| 5,168,685 | A | 12/1992 | Suzuki |
| 5,195,297 | A | 3/1993 | Lancaster |
| 5,203,939 | A | 4/1993 | Sperling |
| 5,211,353 | A | 5/1993 | Lewin |
| 5,307,609 | A | 5/1994 | Kurata |
| 5,315,808 | A | 5/1994 | MacIvor |
| 5,358,594 | A | 10/1994 | Darrieux |
| 5,385,001 | A | 1/1995 | Ramer |
| 5,409,177 | A | 4/1995 | Parry |
| 5,447,009 | A | 9/1995 | Oleksy |
| 5,535,962 | A | 7/1996 | Bargowski |
| 5,561,971 | A | 10/1996 | Sampson |
| 5,653,293 | A | 8/1997 | Ellis |
| 5,797,246 | A | 8/1998 | Martin-Cocher |
| 5,819,503 | A | 10/1998 | Lancaster, III |
| 5,878,555 | A | 3/1999 | Turfan |
| 5,965,262 | A | 10/1999 | Whisler |
| 6,065,269 | A | 5/2000 | Malnati |
| 6,102,313 | A | 8/2000 | Salzsauler |
| 6,164,047 | A | 12/2000 | Rossi |
| 6,311,459 | B1 | 11/2001 | Rossi |
| 6,393,808 | B1 | 5/2002 | Kallner |
| 6,688,076 | B1 | 2/2004 | Rivera, Jr. |
| 6,745,544 | B2 | 6/2004 | Matsumoto |
| 6,775,956 | B1 | 8/2004 | Lacey |
| 6,796,105 | B2 | 9/2004 | Rossi |
| 6,883,298 | B2 | 4/2005 | Gooding |
| 6,892,515 | B2 | 5/2005 | Mauro |
| 6,971,220 | B1 | 12/2005 | Rampp |
| 7,029,206 | B2 | 4/2006 | Stockstill |
| 7,269,935 | B2 | 9/2007 | Jafari |
| 7,581,368 | B1 | 9/2009 | Bison |
| 7,621,107 | B2 | 11/2009 | Vanderheiden |
| 7,908,831 | B1 | 3/2011 | Dugan |
| 8,046,975 | B1 | 11/2011 | Bison |
| 8,053,056 | B2 | 11/2011 | Heikaus |
| 8,276,349 | B2 | 10/2012 | Van Amstel |
| 8,528,615 | B2 | 9/2013 | Colson |
| 8,549,819 | B1 | 10/2013 | Bison |
| 8,637,134 | B1 | 1/2014 | Aronsen |
| 8,707,664 | B1 | 4/2014 | Bison |
| 8,984,848 | B2 | 3/2015 | Bison |
| 9,254,931 | B2 | 2/2016 | Bison |
| 9,802,722 | B1 | 10/2017 | Bison |
| 10,279,945 | B2 | 5/2019 | Nelson |
| 10,526,099 | B2 | 1/2020 | Bison |
| 10,960,998 | B2 | 3/2021 | Nicholson |
| 11,434,029 | B1 | 9/2022 | Bison |
| 11,628,959 | B1 | 4/2023 | Bison |
| 2004/0244336 | A1 | 12/2004 | Suolahti |
| 2005/0123721 | A1 | 6/2005 | Heikaus |
| 2008/0066431 | A1 | 3/2008 | Cousins |
| 2008/0092489 | A1 | 4/2008 | Smith |
| 2008/0209859 | A1 | 9/2008 | Vanderheiden |
| 2009/0178374 | A1 | 7/2009 | Lancaster, III |
| 2009/0277136 | A1 | 11/2009 | Van Amstel |
| 2009/0293425 | A1 | 12/2009 | Carter |
| 2011/0088359 | A1 | 4/2011 | Brocard |
| 2012/0102887 | A1 | 5/2012 | Lancaster, III |
| 2013/0104754 | A1 | 5/2013 | Van Amstel |
| 2013/0326999 | A1 | 12/2013 | Lemieux |
| 2014/0331609 | A1 | 11/2014 | Bison |
| 2015/0197355 | A1 | 7/2015 | Bison |
| 2015/0353220 | A1 | 12/2015 | Lancaster, III |
| 2016/0098171 | A1 | 4/2016 | Lancaster, III |
| 2017/0101205 | A1* | 4/2017 | Schieck ..... B65B 11/025 |
| 2018/0208339 | A1 | 7/2018 | Bison |
| 2018/0257799 | A1 | 9/2018 | Ragsdale |
| 2019/0084703 | A1 | 3/2019 | Nicholson |
| 2020/0299016 | A1 | 9/2020 | Lancaster, III |
| 2020/0377250 | A1 | 12/2020 | Lancaster, III |

FOREIGN PATENT DOCUMENTS

| | | | |
|---|---|---|---|
| DE | 3933952 | C1 | 5/1990 |
| DE | 19505240 | | 3/1996 |
| EP | 0178145 | A1 | 4/1986 |
| EP | 1332968 | A1 | 8/2003 |
| EP | 1803345 | A1 | 7/2007 |
| EP | 2589540 | A1 | 5/2013 |
| EP | 3070003 | A1 | 9/2016 |
| GB | 2241484 | A | 9/1991 |
| JP | H0245309 | | 2/1990 |
| JP | H04215903 | | 8/1992 |
| JP | H04327108 | | 11/1992 |
| JP | H10129609 | | 5/1998 |
| JP | 10129609 | A | 5/1999 |
| JP | 2000302102 | A | 10/2000 |
| JP | 2002166905 | A | 6/2002 |
| JP | 2002211502 | A | 7/2002 |
| JP | 2002225806 | A | 8/2002 |
| JP | 2002225807 | A | 8/2002 |
| WO | 9012737 | A1 | 11/1990 |
| WO | 2009155713 | A2 | 12/2009 |

OTHER PUBLICATIONS

JPO machine translation of JP 2002-225806 A, Aug. 14, 2013, 15 pages.

USPTO translation of JP 2-45309 A, Aug. 13, 2013, 7 pages.

* cited by examiner

PALLET WRAPPING SYSTEM WITH INTELLIGENT MONITORING

CROSS REFERENCE TO RELATED APPLICATIONS

This application is a continuation of U.S. Utility patent application Ser. No. 17/570,269 entitled "Pallet Wrapping System With Intelligent Monitoring" to Bison that was filed on Jan. 6, 2022, the disclosure of which is hereby incorporated herein by this reference.

TECHNICAL FIELD

Aspects of this document relate generally to monitoring systems, and more specifically to monitoring systems for wrapping a pallet with stretch film.

BACKGROUND

Pallets are commonly wrapped in stretch film to provide stability and protection to palletized loads during transit. While the price to wrap one pallet with stretch film is insignificant, this price repeated for thousands or millions of pallets quickly becomes significant. Thus, there is a need to reduce the cost of stretch film per pallet.

SUMMARY

Aspects of this document relate to a monitoring system for wrapping a pallet comprising a pallet wrapping system having a spool configured to dispense stretch film, a pre-stretch machine operably coupled to the pallet wrapping system and configured to elongate the stretch film, and a pallet platform configured to support a palletized load as the stretch film is wrapped around the palletized load, at least two encoders affixed to the pre-stretch machine, wherein a first encoder of the at least two encoders is configured to measure a length of stretch film entering the pre-stretch machine and a second encoder of the at least two encoders is configured to measure a length of stretch film exiting the pre-stretch machine, and a control box communicatively coupled to the at least two encoders and configured to collect data regarding the pallet wrapping system and transmit the data over a cellular connection to a central processor configured to gather the data, the data including characteristics of the pallet wrapping system's operation sufficient to calculate at least the following measurements: a weight of stretch film wrapped around each pallet, a number of times the stretch film is wrapped around each pallet, a length of stretch film pulled into the pre-stretch machine per pallet, a length of stretch film applied to each pallet, an amount of stretch film remaining on a roll of stretch film when the roll of stretch film is replaced, an amount of time for the pallet wrapping system to wrap each pallet, and a number of web breaks in a specified time period, wherein each of the measurements has a corresponding range of acceptable values and the monitoring system is configured to notify a third party when any of the measurements leaves the corresponding range of acceptable values.

Particular embodiments may comprise one or more of the following features. The measurements may further include an amount of stretch film available to a user of the pallet wrapping system for wrapping one or more palletized loads. The control box may be further configured to receive a selected configuration of the measurements for wrapping the palletized load from a user of the pallet wrapping system and implement the selected configuration in wrapping the palletized load.

Aspects of this document relate to a monitoring system for wrapping a pallet comprising a pallet wrapping system having a spool configured to dispense stretch film and a pre-stretch machine operably coupled to the pallet wrapping system and configured to elongate the stretch film, and a control box configured to collect data regarding the pallet wrapping system and transmit the data over a wireless connection to a central processor configured to gather the data, the data including characteristics of the pallet wrapping system's operation sufficient to calculate at least the following measures: a weight of stretch film wrapped around each pallet, a length of stretch film pulled into the pre-stretch machine per pallet, a length of stretch film applied to each pallet, and an amount of stretch film remaining on a roll of stretch film when the roll of stretch film is replaced, wherein each of the measurements has a corresponding range of acceptable values and the monitoring system is configured to notify a third party when any of the measurements leaves the corresponding range of acceptable values.

Particular embodiments may comprise one or more of the following features. The monitoring system may further comprise at least two encoders affixed to the pre-stretch machine, wherein a first encoder of the at least two encoders is configured to measure a length of stretch film entering the pre-stretch machine and a second encoder of the at least two encoders is configured to measure a length of stretch film exiting the pre-stretch machine, wherein the control box is communicatively coupled to the at least two encoders. The wireless connection may be a cellular connection. The measurements may further include an amount of time for the pallet wrapping system to wrap each pallet. The measurements may further include a number of web breaks in a specified time period. The measurements may further include a number of times the stretch film is wrapped around each pallet.

Aspects of this document relate to a monitoring system for wrapping a pallet comprising a pallet wrapping system having a pre-stretch machine configured to elongate stretch film, and a control box configured to collect data regarding the pallet wrapping system, the data including characteristics of the pallet wrapping system's operation sufficient to calculate at least the following measurements: a length of stretch film pulled into the pre-stretch machine per pallet; and a length of stretch film pulled out of the pre-stretch machine per pallet, wherein each of the measurements has a corresponding range of acceptable values and the monitoring system is configured to notify a third party when any of the measurements leaves the corresponding range of acceptable values.

Particular embodiments may comprise one or more of the following features. The control box may be configured to transmit the data over a wireless connection to a central processor configured to gather the data. The measurements may further include a weight of stretch film wrapped around each pallet. The measurements may further include an amount of stretch film remaining on a roll of stretch film when the roll of stretch film is replaced. The measurements may further include an amount of stretch film available to the third party. The measurements may further include an amount of time for the pallet wrapping system to wrap each pallet. The measurements may further include a number of web breaks in a specified time period. The measurements may further include a number of times the stretch film is wrapped around each pallet. The monitoring system may be further configured to receive a selected configuration of the measurements for wrapping the palletized load from a user of the pallet wrapping system and implement the selected configuration in wrapping the palletized load. The monitoring system may further comprise at least two encoders affixed to the pre-stretch machine, wherein a first encoder of the at least two encoders is configured to measure a length of stretch film entering the pre-stretch machine and a second encoder of the at least two encoders is configured to measure a length of stretch film exiting the pre-stretch machine, wherein the control box is communicatively coupled to the at least two encoders. The wireless connection may be a cellular connection.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . "or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
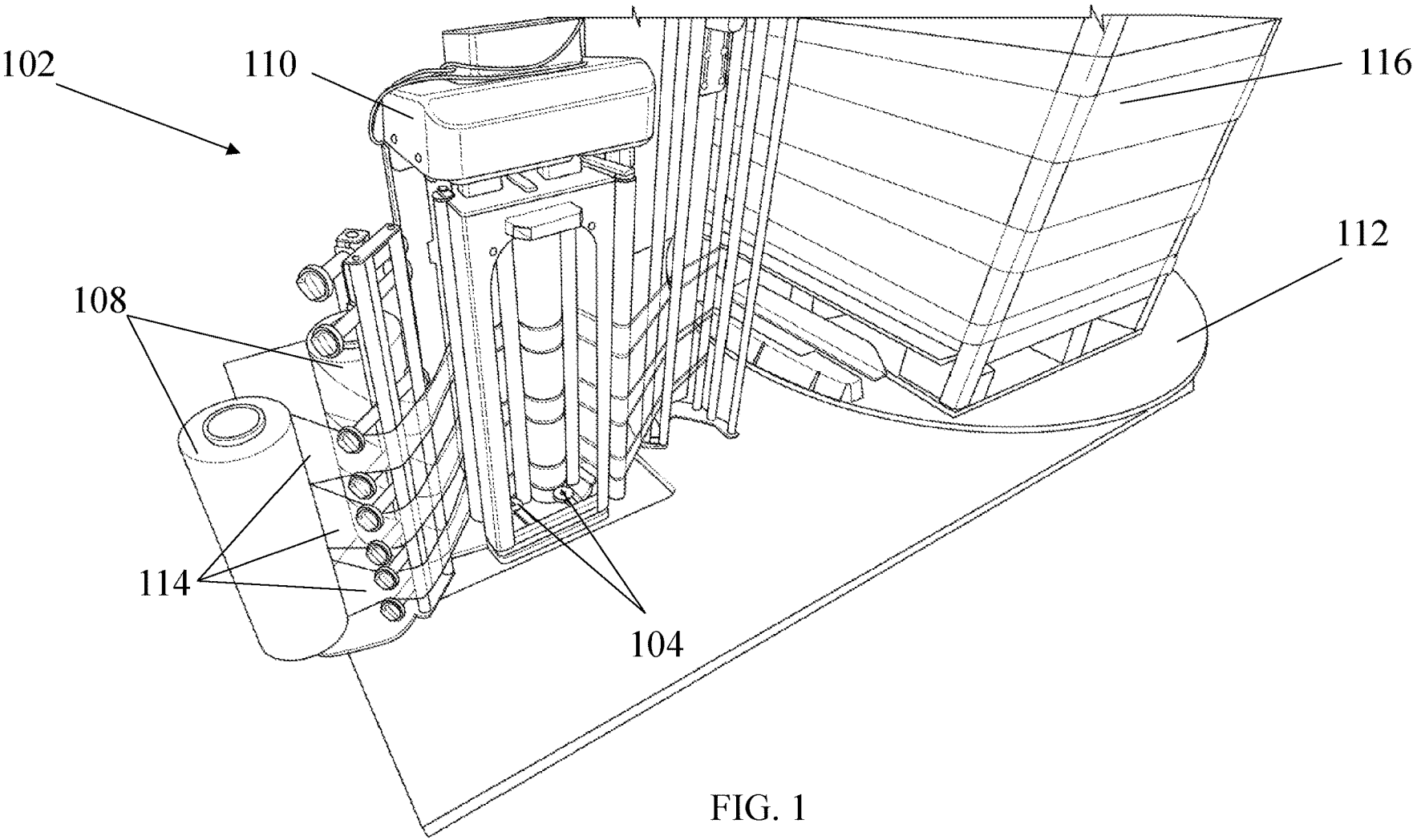
FIG. 1 is a perspective view of a monitoring system for wrapping a pallet.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure is related to a monitoring system 100 for wrapping a pallet. The monitoring system 100 may comprise a pallet wrapping system 102, at least two encoders 104, and a control box 106. The monitoring system 100 is configured to track data regarding the usage and status of the pallet wrapping system 102. As shown in FIG. 1, the pallet wrapping system 102 may have a spool 108, a pre-stretch machine 110, and a pallet platform 112. The spool 108 is configured to dispense stretch film 114 and the pre-stretch machine 110 is operably coupled to the pallet wrapping system 102 and configured to elongate the stretch film 114. For example, the pre-stretch machine 110 may eject stretch film 114 faster than stretch film 114 enters the pre-stretch machine 110. This stretches the stretch film 114 within the pre-stretch machine 110 to create a difference between the length of stretch film 114 entering the pre-stretch machine 110 over time and the length of stretch film 114 exiting the pre-stretch machine 110 over time. This pre-stretch enhances the tightness that the film 114 is able to wrap around a pallet as the stretched film 114 tends to move toward an unstretched state if the tension is released. Thus, after the pallet is wrapped and the stretch film 114 is released, the stretch film 114 contracts as far as is possible to move toward that unstretched state, tightening around the pallet. The higher the tension, the tighter the force holding the load being wrapped. However, too high of tension and the film will tear. The pallet platform 112 is configured to support a palletized load 116 as the stretch film 114 is wrapped around the palletized load 116.

Figure 2:
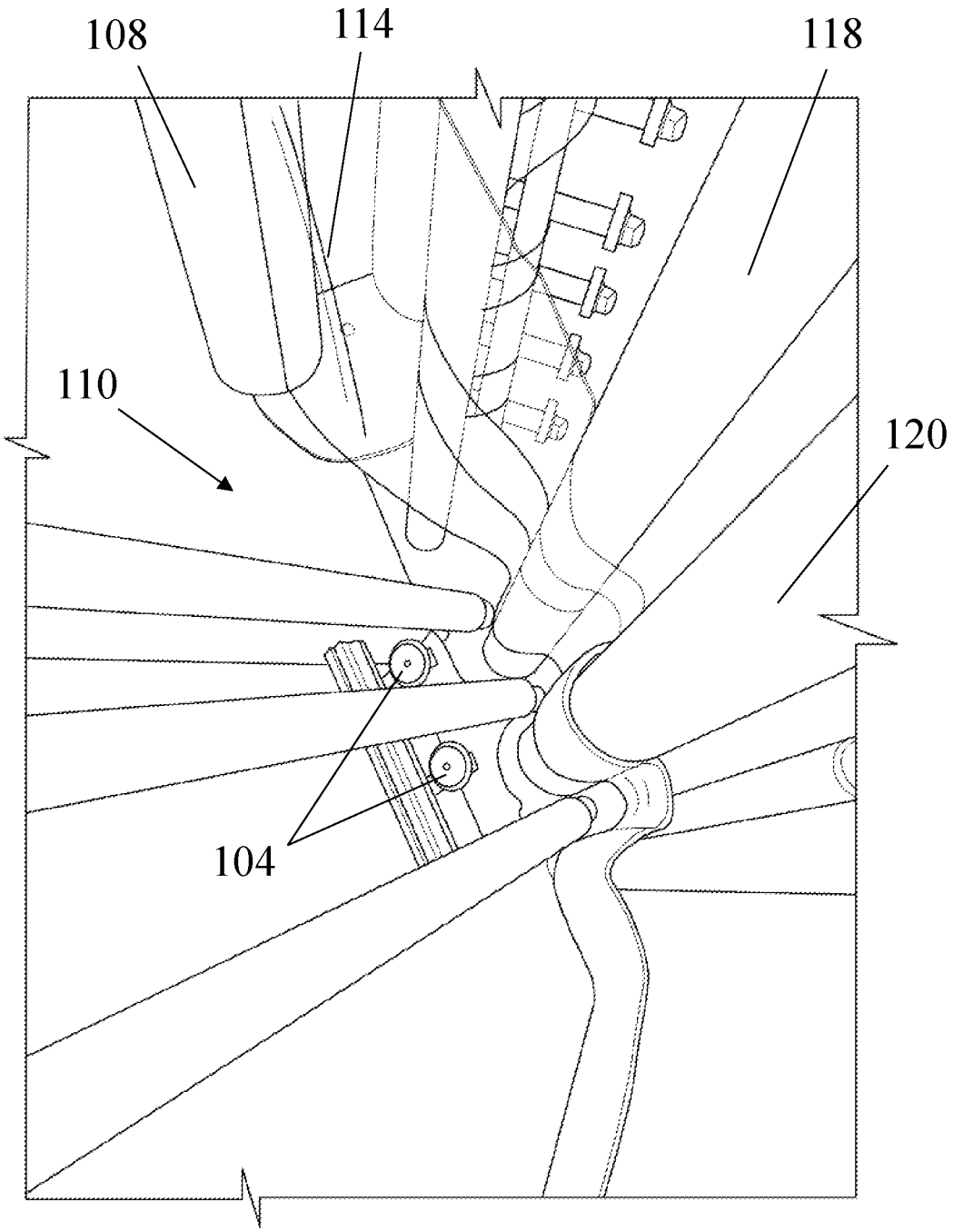
FIG. 2 is a close up view of the pre-stretch machine shown in FIG. 1 with the door open to expose the encoders.

As shown in FIG. 2, the at least two encoders 104 may be affixed to the pre-stretch machine 110. In some embodiments, the at least two encoders 104 are affixed to the door of the pre-stretch machine 110. Thus, when the door is opened, the encoders disengage from the stretch film 114 automatically and when the door is closed, the encoders reengage without any operator intervention. Any type of encoder 104 capable of measuring a length of stretch film 114 passing the encoder 104 may be used. As a particular example, the encoders 104 may be rotary encoders, such as mechanical, magnetic, resistive, or optical encoders, etc. Each of the at least two encoders 104 may have a wheel configured to rotate. In such an embodiment, as stretch film 114 passes by each of the encoders 104 and comes into contact with the wheel of each encoder 104, the wheel is rotated by the stretch film 114 to eliminate inaccurate measurement. Thus, the at least two encoders 104 may be configured to measure a length of stretch film 114 that passes the encoders 104 by counting the rotations and multiplying the diameter of the wheel by 3.14159. The encoders 104 may be spring loaded such that, when the door of the pre-stretch machine 110 is closed, the encoders 104 pin the stretch film 114 against the first roller 118 or the second roller 120. This decreases the amount of slippage that occurs between the encoders 104 and the stretch film 114, which improves the accuracy of the measurements taken by the encoders 104. Other sensors capable of measuring the length of the stretch film 114 passing through may also be used.

The first encoder 104 of the at least two encoders 104 may be configured to measure the length of stretch film 114 entering the pre-stretch machine 110 from the spool 108, while the second encoder 104 of the at least two encoders 104 may be configured to measure a length of stretch film 114 exiting the pre-stretch machine 110. These measurements may be taken by placing the first encoder 104 such that the first encoder 104 is in contact with the stretch film 114 on a first roller 118 of the pre-stretch machine 110 which pulls the stretch film 114 into the pre-stretch machine 110. Thus, the first encoder 104 is able to measure the length of stretch film 114 that enters the pre-stretch machine 100. Similarly, the second encoder 104 may be placed such that the second encoder 104 is in contact with the stretch film 114 on a second roller 120 of the pre-stretch machine 110 which has a surface speed faster than that of the first roller 118, stretching the stretch film 114 within the pre-stretch machine 110. The second encoder 104 is thus able to measure the length of stretch film 114 that exits the pre-stretch machine 100.

Figure 3:
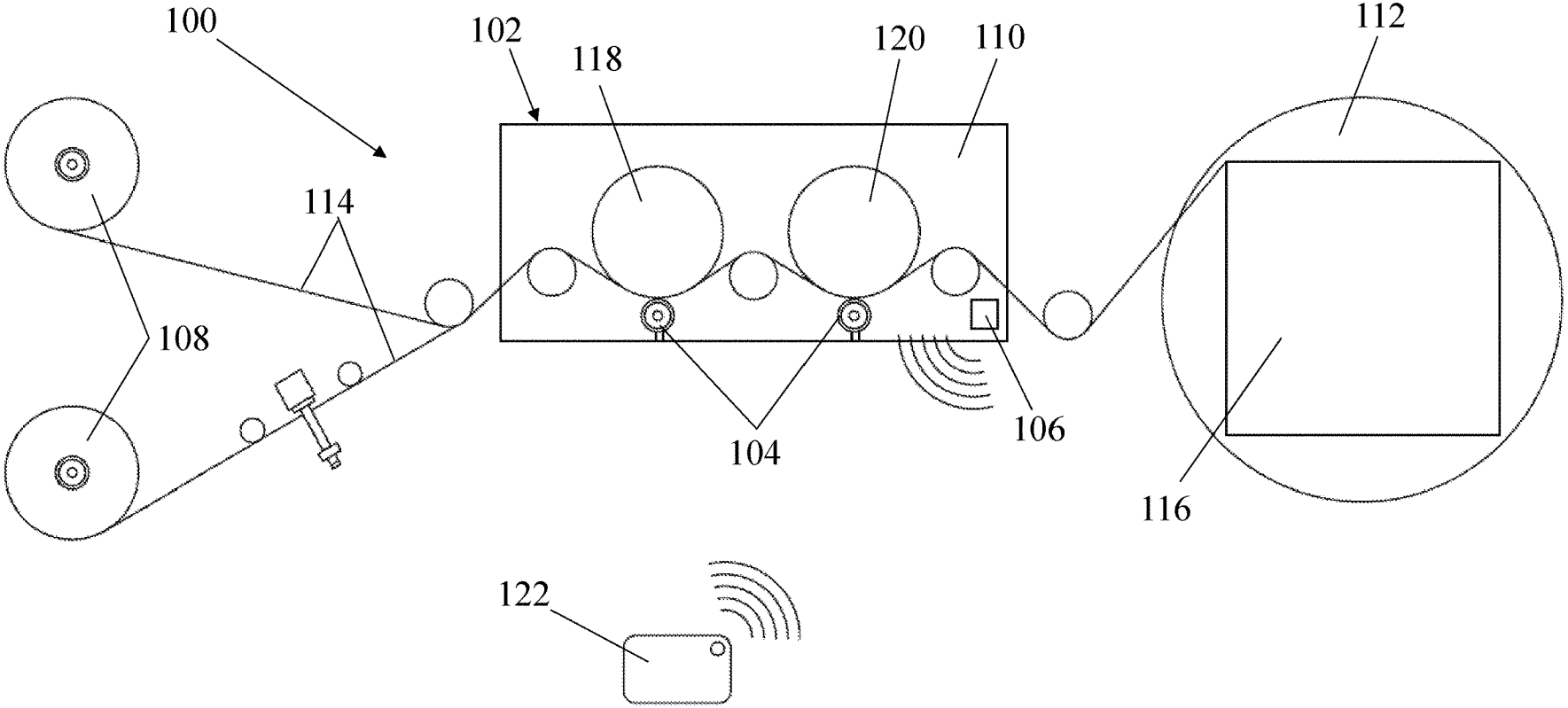
FIG. 3 is a top view of the monitoring system shown in FIG. 1.

The control box 106 is communicatively coupled to the at least two encoders 104. The control box 106 is configured to collect data regarding the pallet wrapping system 102. The data may be transmitted over a wireless connection to a central processor 122 configured to gather the data, as shown in FIG. 3. The central processor 122 may be a cloud-based processor. The wireless connection may be a cellular connection, wi-fi, Bluetooth or any other wireless communication method known. The data may be collected from sensors electrically coupled to the control box 106, such as the at least two encoders 104 described above. The data may also be collected from the user, who may input certain data into the monitoring system 100. For example, the user may enter the particular type of stretch film 114 being used or otherwise provide the monitoring system 100 with data such as the linear weight of the stretch film 114, the density of the stretch film 114, the thickness of the stretch film 114, the width of the stretch film 114, and/or any other relevant characteristics of the stretch film 114. The user may also select or input characteristics for how the pallet wrapping system 102 wraps the palletized load 116. For example, the user may select a number of times the stretch film 114 is to be wrapped around each pallet, as well as the wrapping tension, the height of the wraps from the floor, and other characteristics. These selections are then implemented by the control box 106. In addition, the user may input certain measurements relevant to the monitoring system 100. For example, the user may input a measured perimeter or circumference of the palletized load 116.

In some implementations, the monitoring system 100 is configured to determine the total applied stretch of the stretch film 114 applied to each pallet. The total applied stretch is the difference between the length of stretch film 114 dispensed from the roll of stretch film 114 and the length of stretch film 114 wrapped around the pallet. The stretch film 114 may be stretched twice during the wrapping process. First, the stretch film 114 may be stretched as it passes through the pre-stretch machine 110, as described above. Second, the stretch film 114 may be stretched as it is applied to the palletized load. The encoders 104 may be configured to measure the amount of stretch applied within the pre-stretch machine 110. To determine the amount of stretch applied as the stretch film 114 is applied to the palletized load, the measured perimeter of the pallet may be multiplied by the number of times the pallet was wrapped to obtain a length of stretch film 114 wrapped around the palletized load, and this length is compared to the length of stretch film 114 that exited the pre-stretch machine 110 over the same interval. The difference between these two values provides the amount of stretch applied during wrapping. The total applied stretch is therefore the sum of the stretch applied within the pre-stretch machine 110 and the stretch applied during wrapping. Alternatively, the total applied stretch may be determined by finding the difference between the length of stretch film 114 wrapped around the palletized load and the length of stretch film 114 removed from the roll of stretch film 114. The total applied stretch may also be determined by using the density, the width, the thickness, and the weight of the stretch film 114 to find the length of the stretch film 114 dispensed from the roll of stretch film 114, and then compare this value to the perimeter of the palletized load multiplied by the number of times the palletized load was wrapped.

The data collected by the control box 106 may include characteristics of the operation of the pallet wrapping system 102 that together are sufficient to calculate various measurements that are useful to the operator of the pallet wrapping system 102. The measurements may include a length of stretch film 114 pulled into the pre-stretch machine 110 per pallet, a length of stretch film 114 pulled out of the pre-stretch machine 110 per pallet, and a length of stretch film 114 wrapped around the palletized load. The measurements may also include a weight of stretch film 114 that is wrapped around each pallet and a number of times the stretch film 114 is wrapped around each pallet. Such measurements help the operator or user to verify that the stretch film 114 is being used efficiently, as overwrapping a pallet increases the cost. Additionally, knowing the weight of stretch film 114 wrapped around each pallet helps the operator to know what percentage of a roll of stretch film 114 is being used per pallet, and how much of the roll remains at the end of wrapping a particular pallet, which can help also increase efficiency and save costs.

The measurements may also include an amount of stretch film 114 remaining on a roll of stretch film when the roll of stretch film is replaced. The amount of stretch film 114 may be measured as a weight or as a length or footage. Knowing the weight or quantity of stretch film 114 being discarded without being used allows the user and third parties to reduce waste, and thus reduce costs. For example, if an operator arrives at his work shift and knows that if the operator puts a new roll of stretch film on the pallet wrapping system 102 immediately, then the operator won't need to replace the roll of stretch film for the entire shift, the operator may be tempted to do so, increasing the cost to the employer and increasing film waste. However, if the employer has the capability of knowing how much stretch film 114 the operator wasted, the operator is discouraged from wasting the stretch film 114 just for a little convenience. This also gives the employee the ability to know if the amount of film left on a roll is enough to wrap a full pallet to optimize film and roll usage. The measurements may also include an amount of time for the pallet wrapping system 102 to wrap each pallet and a number of web breaks in a specified time period. Knowing the amount of time for wrapping each pallet helps the operator to know how quickly each pallet is being wrapped, and thus to increase the wrapping speed to a certain limit. By wrapping each pallet faster, more pallets can be wrapped in the same amount of time. The operator is also able to use the measurement of the amount of time to wrap each pallet to balance working efficiently and maintaining quality, as wrapping the pallets too quickly may decrease the quality of the wrap or increase the likelihood of tearing the stretch film 114. The number of web breaks in a specified period of time allows the operator to track how often pallet wrapping is interrupted. The measurements may also include an amount of stretch film 114 available to a user of the pallet wrapping system 102 for wrapping one or more palletized loads 116. As the stretch film 114 is used up, the monitoring system 100 may track how much stretch film 114 is left, as well as how many rolls of stretch film 114 are in stock on the worksite. Thus, as the stretch film 114 available to the user runs low, the user or a third party may be notified so that additional rolls of stretch film 114 can be purchased, ordered, or released.

As can be seen from the description of different measurements that may be calculated based on the data gathered by the control box 106, the monitoring system 100 enables the collection of data that helps the user verify proper load containment, improve efficiency, and reduce the costs involved in wrapping pallets with stretch film 114 by flagging when settings of the pallet wrapping system 102 have been changed outside of acceptable ranges. For example, in some cases, a user of the pallet wrapping system 102 may incorrectly believe that the current settings are inappropriate, such as the wrapping tension being too high or the number of wraps being too low, and make a change to the settings to reduce the tension and increase the number of wraps. As discussed above, this leads to wasted stretch film 114 and in fact may reduce the security of the palletized load 116. Thus, the monitoring system 110 may notify the user that settings of the pallet wrapping system 102 have been adjusted outside of acceptable levels to provide training to the user. In addition, the monitoring system may notify a manager, supervisor, or other third party that undesired changes have been made. By flagging issues early, the monitoring system 100 reduces the cost of such errors. In addition, the monitoring system 100 can flag issues as the pallet wrapping system 102 wears over time.

As mentioned above, each of the measurements may have a corresponding range of acceptable values, and the monitoring system 100 may be configured to notify a third party such as an owner, manager, or supervisor when any of the measurements leaves this corresponding range of acceptable values. This allows the third party to monitor and regulate each of the measurements and receive notice when something goes wrong. For example, there may be a range of acceptable differences between the length of stretch film 114 pulled into the pre-stretch machine 110 and the length of stretch film 114 pushed out of the pre-stretch machine 110 which leads to a proper level of pre-stretch in the stretch film 114. Thus, if these two measurements become too close together (which would imply too little pre-stretch, leading to a loose wrap) or too far apart (which would imply too much pre-stretch, leading to tearing), the third party may be notified by the monitoring system 100, allowing the third party to remedy the situation quickly before significant damage is done or significant time is lost. In some implementations, the monitoring system 100 is configured to track data regarding multiple pallet wrapping systems 102 simultaneously. Thus, the third party can manage and supervise multiple pallet wrapping systems 102 and be notified if something goes wrong with any one of the pallet wrapping systems 102.

In some implementations, the monitoring system 100 may be configured to notify the third party, and then wait to send additional notifications until a specified amount of time has passed or the situation has deteriorated further. Thus, the third party can be notified without being inundated with notifications, but still receive further relevant information such as continuing problems or deteriorating situations. Additionally, the monitoring system 100 may be configured to alert additional third parties if the measurements continue to return unacceptable values. Thus, if one third party fails to fix the problem, additional interested parties can be involved. In some implementations, the pallet wrapping system 102 may be configured to include a notice beacon or light visible at the particular workstation, and in some embodiments beyond the particular workstation, such as on a pole. The light is configured to illuminate in conjunction with an alert being sent to a third party. This allows the user to be aware that a warning has been sent and fix the problem before the third party gets involved.

The control box 106 may be configured to receive a selected configuration of the measurements for wrapping the palletized load 116 from the user, and may be configured to implement the selected configuration in wrapping the palletized load 116. For example, the selected configuration may specify a particular pre-stretch level configuration based on one or more of the length of stretch film 114 pulled into and pulled out of the pre-stretch machine 110, the number of times the stretch film 114 is wrapped around each pallet, the amount of time for the pallet wrapping system 102 to wrap the pallet, and the height of the stretch film 114 wrapped around the pallet over time. The selected configuration of the measurements may be received as a result of the user entering the selected configuration directly into the control box 106. The monitoring system 100 may also be configured to received the selected configuration through a wireless communication.

It will be understood that implementations of a monitoring system for wrapping a pallet are not limited to the specific assemblies, devices and components disclosed in this document, as virtually any assemblies, devices and components consistent with the intended operation of a monitoring system may be used. Accordingly, for example, although particular monitoring systems, and other assemblies, devices and components are disclosed, such may include any shape, size, style, type, model, version, class, measurement, concentration, material, weight, quantity, and/or the like consistent with the intended operation of monitoring systems. Implementations are not limited to uses of any specific assemblies, devices and components; provided that the assemblies, devices and components selected are consistent with the intended operation of a monitoring system.

Accordingly, the components defining any monitoring system may be formed of any of many different types of materials or combinations thereof that can readily be formed into shaped objects provided that the materials selected are consistent with the intended operation of a monitoring system. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various monitoring systems may be manufactured using conventional procedures as added to and improved upon through the procedures described here. Some components defining a monitoring system may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling monitoring systems are not limited to the specific order of steps as disclosed in this document. Any steps or sequence of steps of the assembly of a monitoring system indicated herein are given as examples of possible steps or sequence of steps and not as limitations, since various assembly processes and sequences of steps may be used to assemble monitoring systems.

The implementations of a monitoring system described are by way of example or explanation and not by way of limitation. Rather, any description relating to the foregoing is for the exemplary purposes of this disclosure, and implementations may also be used with similar results for a variety of other applications employing a monitoring system.

What is claimed is:

1. A monitoring system for wrapping a pallet, comprising:

a pallet wrapping system having a spool configured to dispense stretch film, a pre-stretch machine operably coupled to the pallet wrapping system and configured to elongate the stretch film, and a pallet platform configured to support a palletized load as the stretch film is wrapped around the palletized load;

at least two encoders affixed to the pre-stretch machine, wherein a first encoder of the at least two encoders is configured to measure a length of stretch film entering the pre-stretch machine and a second encoder of the at least two encoders is configured to measure a length of stretch film exiting the pre-stretch machine, wherein at least one of the at least two encoders is affixed to a door of the pre-stretch machine; and a control box communicatively coupled to the at least two encoders and configured to collect data regarding the pallet wrapping system and transmit the data over a cellular connection to a central processor configured to gather the data, the data including characteristics of the pallet wrapping system's operation sufficient to calculate at least one of the following measurements:

a weight of stretch film wrapped around each pallet;

a number of times the stretch film is wrapped around each pallet;

a length of stretch film pulled into the pre-stretch machine per pallet;

a length of stretch film applied to each pallet;

an amount of stretch film remaining on a roll of stretch film when the roll of stretch film is replaced;

an amount of time for the pallet wrapping system to wrap each pallet; and a number of web breaks in a specified time period.

2. The monitoring system of claim 1, wherein the measurements further include an amount of stretch film available to a user of the pallet wrapping system for wrapping one or more palletized loads.

3. The monitoring system of claim 1, wherein the control box is further configured to receive a selected configuration of the measurements for wrapping the palletized load from a user of the pallet wrapping system and implement the selected configuration in wrapping the palletized load.

4. A monitoring system for wrapping a pallet, comprising:

a pallet wrapping system having a spool configured to dispense stretch film and a pre-stretch machine operably coupled to the pallet wrapping system and configured to elongate the stretch film;

at least one encoder affixed to a door of the pre-stretch machine, wherein the at least one encoder is either configured to contact and measure a length of stretch film entering the pre-stretch machine or is configured to contact and measure a length of stretch film exiting the pre-stretch machine; and a control box configured to collect data regarding the pallet wrapping system and transmit the data over a wireless connection to a central processor configured to gather the data, the data including characteristics of the pallet wrapping system's operation sufficient to calculate at least one of the following measurements:

a weight of stretch film wrapped around each pallet;

a length of stretch film pulled into the pre-stretch machine per pallet;

a length of stretch film applied to each pallet; and an amount of stretch film remaining on a roll of stretch film when the roll of stretch film is replaced.

5. The monitoring system of claim 4, wherein the at least one encoder comprises a first encoder configured to measure the length of stretch film entering the pre-stretch machine and a second encoder configured to measure the length of stretch film exiting the pre-stretch machine, wherein the control box is communicatively coupled to the first encoder and to the second encoder.

6. The monitoring system of claim 5, wherein the communicatively coupled connection is a cellular connection.

7. The monitoring system of claim 4, wherein the measurements further include an amount of time for the pallet wrapping system to wrap each pallet.

8. The monitoring system of claim 4, wherein the measurements further include a number of web breaks in a specified time period.

9. The monitoring system of claim 4, wherein the measurements further include a number of times the stretch film is wrapped around each pallet.

10. A monitoring system for wrapping a pallet, comprising:

a pallet wrapping system having a pre-stretch machine configured to elongate stretch film;

at least one encoder affixed to a door of the pre-stretch machine and configured to contact the stretch film and measure a length of the stretch film passing the at least one encoder; and a control box configured to collect data regarding the pallet wrapping system, the data including characteristics of the pallet wrapping system's operation sufficient to calculate at least one of a length of stretch film pulled into the pre-stretch machine per pallet, and a length of stretch film pulled out of the pre-stretch machine per pallet.

11. The monitoring system of claim 10, wherein the control box is configured to transmit the data over a wireless connection to a central processor configured to gather the data.

12. The monitoring system of claim 11, wherein the wireless connection is a cellular connection.

13. The monitoring system of claim 10, wherein the measurements further include a weight of stretch film wrapped around each pallet.

14. The monitoring system of claim 10, wherein the measurements further include an amount of stretch film remaining on a roll of stretch film when the roll of stretch film is replaced.

15. The monitoring system of claim 10, wherein the measurements further include an amount of stretch film available to a user of the monitoring system.

16. The monitoring system of claim 10, wherein the measurements further include an amount of time for the pallet wrapping system to wrap each pallet.

17. The monitoring system of claim 10, wherein the measurements further include a number of web breaks in a specified time period.

18. The monitoring system of claim 10, wherein the measurements further include a number of times the stretch film is wrapped around each pallet.

19. The monitoring system of claim 10, wherein the monitoring system is further configured to receive a selected desired configuration of the measurements for wrapping the palletized load from a user of the pallet wrapping system and implement the selected configuration in wrapping the palletized load.

20. The monitoring system of claim 10, wherein the at least one encoder is at least two encoders affixed to the door of the pre-stretch machine, wherein a first encoder of the at least two encoders is configured to measure a length of stretch film entering the pre-stretch machine and a second encoder of the at least two encoders is configured to measure a length of stretch film exiting the pre-stretch machine, wherein the control box is communicatively coupled to the at least two encoders.

* * * * *